US005788416A

United States Patent [19]

Wolgamot

[11] Patent Number: 5,788,416

[45] Date of Patent: Aug. 4, 1998

[54] PORTABLE MODULAR DOCK SYSTEM

[76] Inventor: Steven F. Wolgamot, 1837 Park Ave., Mahtomedi, Minn. 55115

[21] Appl. No.: 612,300

[22] Filed: Mar. 7, 1996

[51] Int. Cl.[6] ..... F02B 3/20

[52] U.S. Cl. ..... 405/218; 405/220

[58] Field of Search ..... 405/3, 4, 218, 405/220, 221; 114/44; 403/378, 358, 102

[56] References Cited

U.S. PATENT DOCUMENTS

| | | | |
|---|---|---|---|
| 2,564,123 | 8/1951 | Melges et al. | 405/221 |
| 3,999,397 | 12/1976 | Albazy | 405/215 |
| 4,037,420 | 7/1977 | Wicks | 405/218 |
| 4,087,977 | 5/1978 | Kuhlman | 405/218 |
| 4,398,849 | 8/1983 | Moran et al. | 405/221 |
| 4,645,380 | 2/1987 | Hambrick et al. | 405/220 |
| 4,923,336 | 5/1990 | Schmidt | 405/221 |
| 4,948,300 | 8/1990 | Bateson | 405/220 |
| 4,981,397 | 1/1991 | Wiltse | 405/218 |
| 5,156,493 | 10/1992 | Johnson | 405/221 |

*Primary Examiner*—Tamara L. Graysay
*Assistant Examiner*—Frederick L. Lagman

[57] ABSTRACT

A portable dock system consisting of aluminum tubular longitudinal and transverse elements, arranged to provide high torsional rigidity. The design incorporates an integral handle for installation and a guide and clamp system for leg installation. These elements permit the easy installation of the dock without use of floats, wheels or hinges.

7 Claims, 5 Drawing Sheets

PORTABLE MODULAR DOCK SYSTEM

BACKGROUND OF THE INVENTION

1. Field of the Invention

The invention is a portable, modular, dock system made with sections created from aluminum tubular longitudinal and transverse elements, arranged to provide high torsional rigidity. It is intended for application as a portable dock or pier, supported by the bottom of the lake or river bed, which can be removed and reinstalled easily.

2. Prior Art

The lakes of the upper midwest are used extensively for recreation. Summer recreation includes boating, swimming and sunning, all of which are greatly facilitated by docks. Winter ice cover requires the removal of nearly all such docks in the fall and their reinstallation in the spring.

These facts, plus varying topography, create numerous design constraints and limitations for docks. The water may be extremely cold in the spring, so dock installation without the need to get in the water is important.

Other constraints are equally significant. Shoreline terrain may be rugged and space very limited, so off-season storage should be compact and simple. Water depth may change during the warm season, so the system must be capable of height adjustment.

Frequently, installation help may not be available, so the dock system should be capable of installation by a single, unaided adult.

Storms are common, so the system requires sufficient stability and integrity to remain upright in bad weather. Uses of docks vary widely, so it is essential to provide for a wide range of configurations and for the installation of accessories such as benches, ladders and platforms.

Prior dock systems designed to sit on the bottom of the lake or river bed have used different arrangements for placing the lakeward (or outer) end of the dock in position. Among the arrangements utilized are wheels rolling on the lake bottom, floats, and hinges permitting the dock section to swing through a vertical plane.

The first arrangement, wheels, requires expensive, heavy gear. The bulk of the wheels and axles precludes nesting sections for storage, so that such dock systems require large amounts of space for storage. Finally, while the sections may be relatively easily manipulated on comparatively flat, hard ground or lake bottoms, they prove very difficult to move over obstacles or banks.

The second arrangement, floats, is hindered by the presence of wind or waves. In addition, it requires either that the dock be raised after installation to free it from the float, or that the float be forced out from under the dock, entailing considerable force if the float is intended to support both dock section and installer.

The third arrangement, hinges, avoids the difficulties of wheels and floats, but requires swinging an unwieldy dock section overhead. This can be cumbersome, and also limits the length of section which may reasonably be used. An example of a system of this type is disclosed in U.S. Pat. No. 4,398,849.

Most existing docks anchor the suporting legs to the dock frame itself by inserting a tubular or pipe leg through a section of somewhat larger tube or pipe. The leg is then secured against vertical movement by a set screw. An example is disclosed in U.S. Pat. No. 3,345,825.

Such leg securing systems have several weaknesses. First, if the dock leg or post has a bearing pad attached to the bottom, the leg cannot be removed from the dock once the dock is erected. This can pose difficulty if a leg is damaged or a longer leg is needed.

Second, concentric tube leg systems which do not have bearing pads on the bottom of the legs must be driven into the bottom of the lake for their support, complicating installation and, especially, removal.

In addition, the concentric tube system of anchoring legs provides limited rigidity. The tapped holes which are common to such systems face harsh environments and may corrode or become stripped, requiring repairs beyond the ability of many end users.

Other prior art includes the use of a Z bracket disclosed in Kuhlman, U.S. Pat. No. 4,087,977; an open sided leg clamp in Johnson, U.S. Pat. No. 5,156,493; and a channel type leg guide in Bateson, U.S. Pat. No. 4,948,300.

What is needed is a dock system that addresses the preceding deficiencies of the prior art.

SUMMARY OF THE INVENTION

A modular section for use in the inventive dock structure has first and second longitudinal members in parallel, spaced relation, each longitudinal member having a lakeward end and a shoreward end. A lakeward transverse member is connected to and extends between the lakeward ends of the first and second longitudinal members. A shoreward transverse member is connected to and extends between the shoreward ends of the first and second longitudinal members. The modular section also has a pair of support legs, one connected to each of the first and second longitudinal members adjacent the lakeward end of such longitudinal member. The first and second longitudinal members and the lakeward and shoreward members are substantially in a common plane and are formed of lightweight tubular material with rigid connections such that a torque applied to the shoreward transverse member that is in a direction to cause rotation about a substantially horizontal axis, and is sufficient to remove all load from one of the support legs, causes no substantial deflection of the first and second longitudinal members and the lakeward and shoreward members out of their common plane.

It is an object of the present invention to provide a modular section for use in a dock that can be manipulated for installation and removal by a person of average strength.

It is another object of the present invention to provide a modular section for use in a dock that can be connected in various ways to make docks of different shapes.

It is a further object of the present invention to provide a modular section for use in a dock that can be installed by a "walking" technique in which the dead weight of a section is alternately shifted between support legs.

DESCRIPTION OF DRAWINGS

A better understanding of the invention will be achieved by reference to the drawings.

FIG. 11 is an overhead plan view of one possible arrangement of a dock built from five dock sections, and the hardware required to accomplish that.

DESCRIPTION OF THE PREFERRED EMBODIMENTS a. Structure

Figure 1:
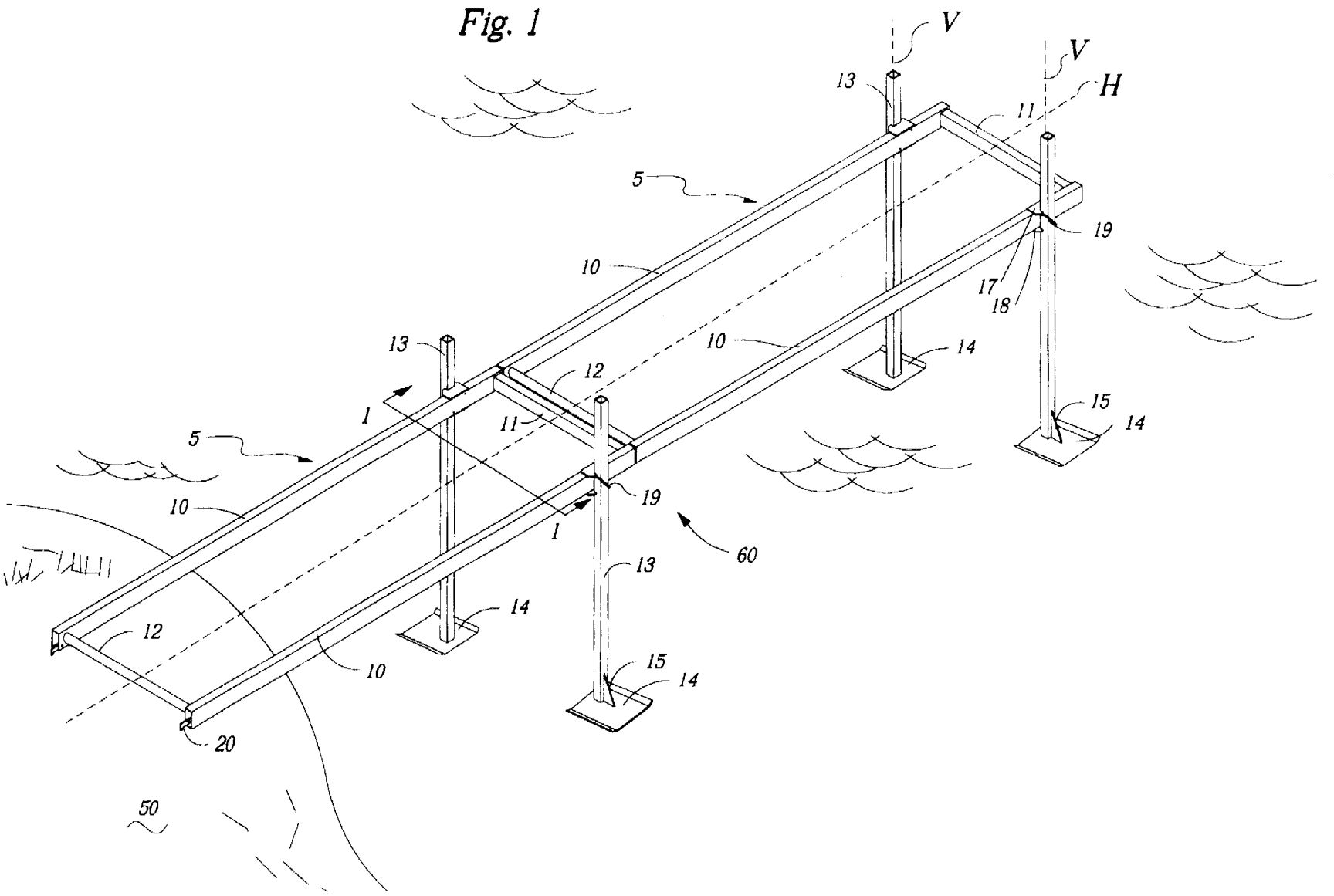
FIG. 1 is a pictorial view of a two section dock according to the present invention without its wooden decking installed.

Referring more particularly to the drawings, FIG. 1 illustrates two, end-to-end connected, modular and portable dock sections 5, comprising a number of aluminum tubular elements and together forming dock 60. (While the discussion will proceed in terms of a dock installed to extend from a lake shore out into the lake, this is just an example to provide orientation. The dock system is applicable to rivers or other bodies of water and could stand free as a platform.) The left end of the leftmost section 5 would typically rest on shore with the remaining structure extending lakeward. Each section 5 includes a pair of parallel tubular longitudinal aluminum members 10, each attached, preferably by welding, at the lakeward (or outer) end to one end of a tubular transverse member 11. Typical longitudinal members would be 2 inches wide by 4 inches high, aluminum tubes, with a rectangular cross section, ⅛ inch thick.

At the shoreward (or inner) end, the longitudinals 10 are attached, preferably by welding, to a shoreward transverse member 12, also aluminum tubing with a round cross section, and of appropriate diameter, e.g. 1.5 to 2 inches, for use as a convenient installation handle, for rotating or carrying a dock section 5 or for applying torque to a dock section 5 for purposes of lifting one leg off the lake bottom. Combining the functions of transverse brace and handle in this element facilitates making a dock section that has members 10,10, 11 and 12 substantially in a common plane and is capable of being installed in the manner described below by one person.

Figure 2:
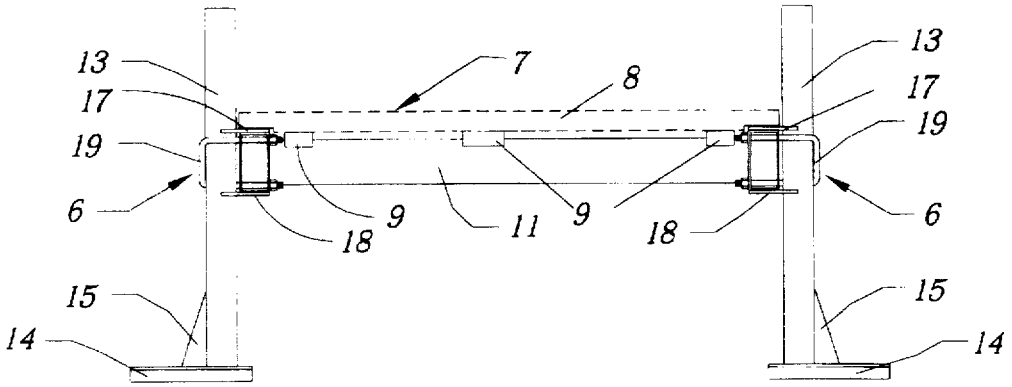
FIG. 2 is a cross sectional view of the dock section near the location of the legs taken at line 1—1 as shown on FIG. 1, with decking added and shown as phantom lines.
Figure 3:
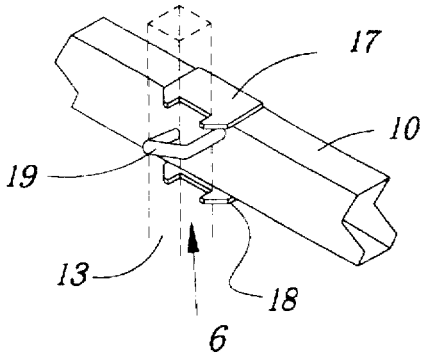
FIG. 3 is a detail of the leg attachment mechanism 6, which shows upper and lower leg guides 17 and 18 and clamp 19.

Referring now also to FIGS. 2 and 3, upper and lower leg guides 17 and 18 are attached to the top and bottom surfaces of the longitudinals 10 near the lakeward end of each section. Each leg 13 is preferably an aluminum tube having a square or rectangular cross-section, preferably with 2 inch by 2 inch dimensions and⅛- walls. Each leg guide in clamping mechanism 6, includes a U shaped recess which closely conforms to the cross-section of leg 13, which serves to hold the tubular leg 13 in position. The recess is open to the outboard side and the recesses above and below a longitudinal member 10 are substantially vertically aligned. A clamp or U bolt 19 holds the leg 13 into the recess of the guide plates 17 and 18. The legs of the U bolt 19 surround the leg 13, pass through holes in the longitudinal members 10, and are secured with nuts on the inboard side of the longitudinal members 10. Alternatively, the leg 13 can be clamped with a horizontally oriented clamp (not shown). However, the diagonal clamp orientation provides somewhat more stability and also locates the clamping bolts 19 closer to the top and bottom webs of the longitudinals 10. The shape and action of the upper and lower leg guides 17 and 18, and the U bolt 19, once firmly tightened, prevent rotation or vertical motion of the leg 13 with respect to the section 5.

Figure 4:
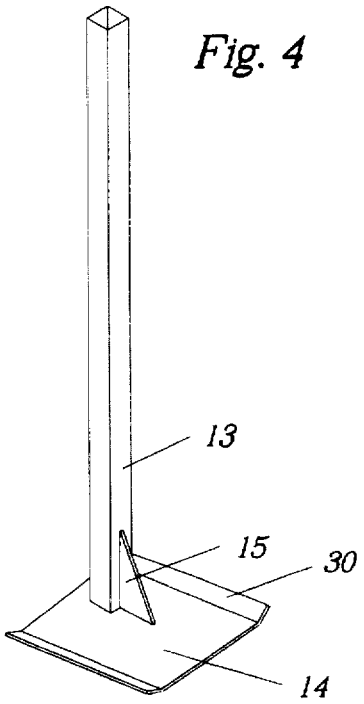
FIG. 4 is a detail of the bottom of a leg 13, showing bearing pad 14, bearing pad gusset 15, and bearing pad flange, 30.

FIG. 1, 2 and 4 show the bearing pads 14, which are welded to the bottom of the legs 13 and additionally secured with bearing pad gussets 15. Note that each bearing pad 14 is deliberately not centered under its respective leg 13, but rather is shifted outboard to enhance stability while retaining very low weight. A bearing pad flange 30, sloping upward at approximately 45 degrees from each of the shoreward and lakeward edges of the pad 14, facilitates the "walking" movement of the assembled section as described below.

FIG. 2 is a cross sectional view looking lakeward at line 1—1, toward the lakeward transverse member 11. It (and FIG. 3) show the location of the upper and lower leg guides 17 and 18 and the use of the U bolt clamp 19 to hold the leg into the guide. Also shown in phantom is a decking pallet assembly 7, which consists of transverse treads 8 which are fastened to longitudinal cleats 9. Decking pallet assemblies are added once a section 5 has been placed.

The use of lightweight tubular members to form a dock section 5 is of significance to the invention, since only by using such tubular members with rigid corner welds connecting members 10, 11 and 12, can the torsional resistance of each section be kept high enough, and weight low enough, to permit the dock section to be "walked" into place.

Figure 5:
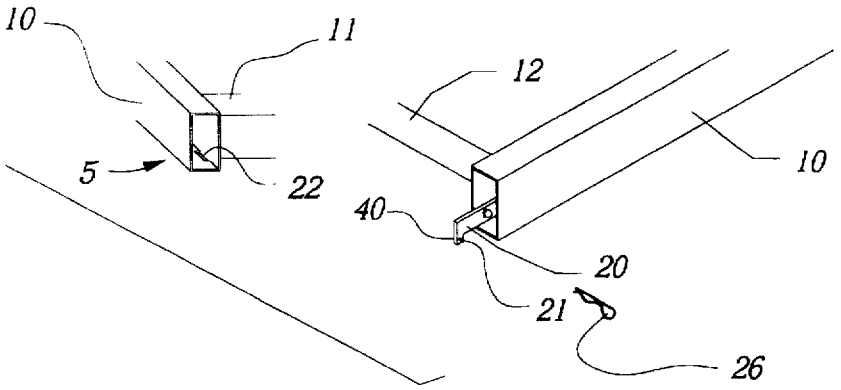
FIG. 5 is a detail of the hook plate 20 and hook plate slot 22 for joining two dock sections 5. The sections 5 are separated and rotated for clarity.

FIG. 5 details a hook plate 20 structure for fastening corresponding corners of two sections 5 together. The aluminum hook plate 20 is bolted to the inside of the inboard surface of the shoreward end of each of the first and second longitudinals 10, of lakeward section 5 to be connected to an adjacent shoreward section 5 (to left in FIG. 5). Hook plate 20 has a hook tab 40 on it which inserts into a slot 22 provided in the lakeward end of the adjacent shoreward section. The hook tab 40 is equipped with a hole 21 which, after the tab 40 is inserted through slot 22, protrudes through the bottom of the longitudinal 10 of the adjacent shoreward section. A safety retaining pin 26 is inserted through this hole and prevents the abutting longitudinals 10 from being unhooked. This creates a joint in which no part of the hook plate 20 extends outboard of the outboard edge of the tubular longitudinal members 10.

Figure 6:
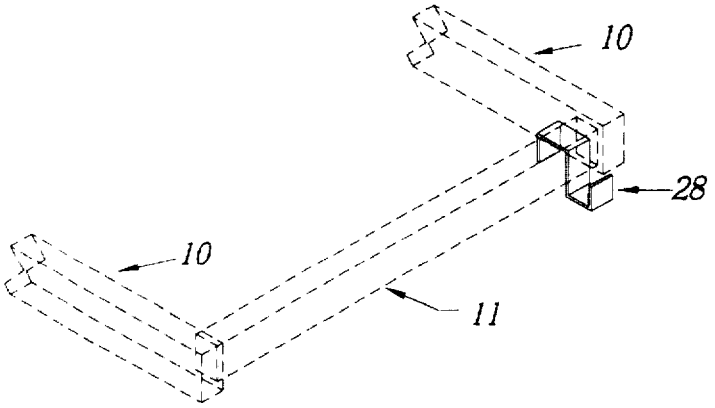
FIG. 6 is a view of a Z clip 28 employed to add a section perpendicularly to the end of a prior section.

FIG. 6 shows a Z clip 28 used to support a section which is to be attached perpendicularly to the lakeward transverse of a previously installed section and across the end of that prior section. The Z clip 28 is a formed metal hanger, one side of which hangs on the lakeward transverse 11, and the other side of which supports the longitudinal element 10 forming one side of the perpendicularly attached section.

Figure 7:
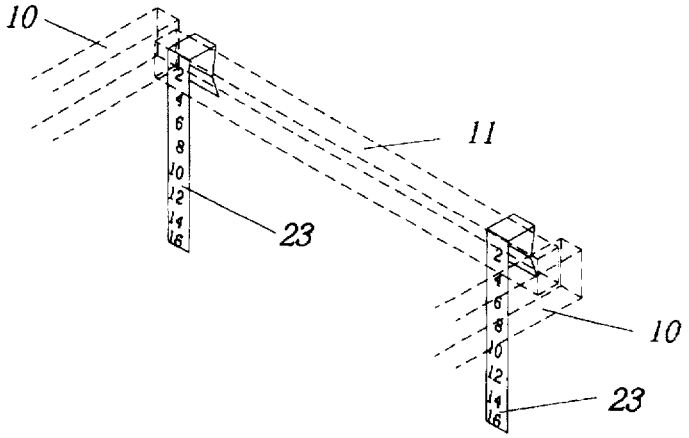
FIG. 7 is a drawing of the gauging attachments 23 used to measure water depth at the outboard end of a section being installed and to level the dock section.

FIG. 7 shows the gauging system which is used to check whether a section being installed will be level. The height gauges 23 are shaped into spring clips at their upper ends that attach by friction to the lakeward transverse member 11. When the section is initially shifted into rough position, the height gauges 23 provide a visual indication of whether the dock section should be raised or lowered with respect to the legs. The numerical markings are arranged to be visible from a distance at least as great as the length of a section 5, and can be used to determine the height of each corner above the water surface.

Figure 8:
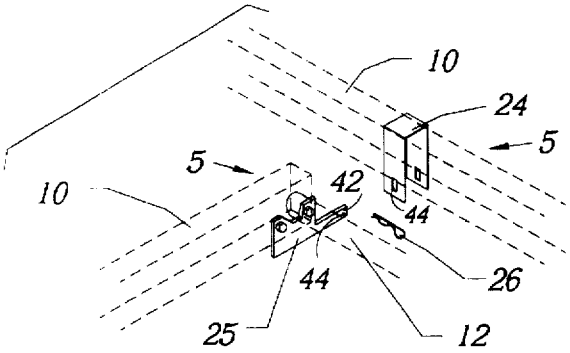
FIG. 8 is an exploded view of a structure for attaching a section perpendicularly to the side of a previously-installed section.

FIG. 8 shows one arrangement for attaching the end of one longitudinal member 10 of a new section 5 perpendicularly to the center of the prior section. A wing support strap 24 of thin material, formed in an inverted U shape, hangs over the longitudinal member 10 of the section 5 already in place. A wing support strut 25 is bolted to the section 5 to be attached. The support strut 25 includes an extension which fits through slots 44 on both sides of the U support strap 24. Once extension 42 is inserted, a safety retaining pin 26 inserted through hole 45 prevents it from coming out.

The wing support strut 25 bolts to the same holes provided for a hook plate 20, which is not used for this kind of installation.

Figure 9:
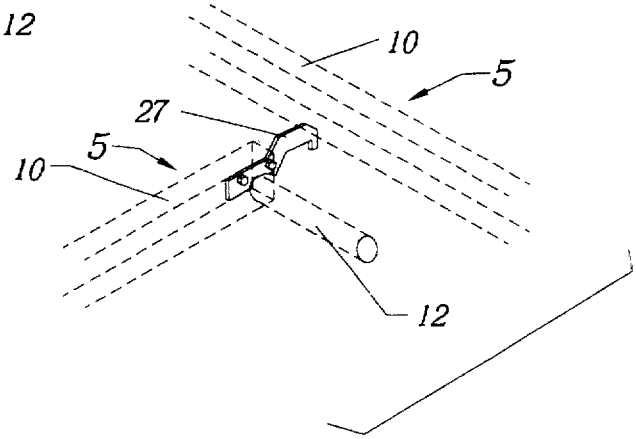
FIG. 9 is an exploded detail view of an alternative structure for attaching a section perpendicularly to the side of a previously installed section.

FIG. 9 shows an alternative structure for attaching the end of one longitudinal member 10 of a new section 5 perpendicularly to a longitudinal member 10 of a prior section 5. This employs a wing plate 27, which is bolted to the section to be attached and hangs on the longitudinal 10 of the previously installed section. The wing plate 27 is also bolted to the same holes provided for the hook plate 20, and the section 5 is inverted for this application.

Figure 10:
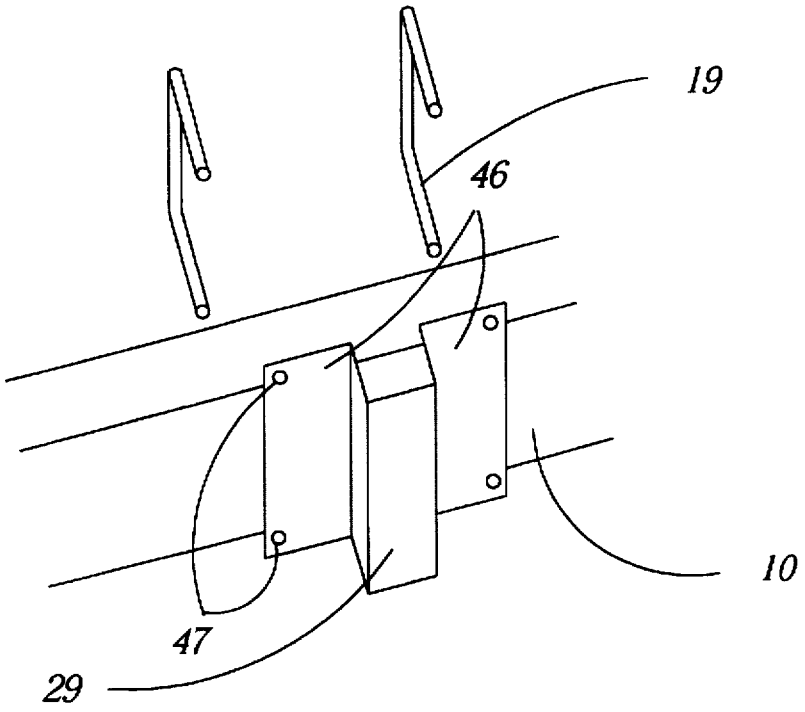
FIG. 10 is an exploded detail view of a housing and clamp structure used to add a leg anywhere needed along the side of a section.

In the straight line dock configuration shown in FIG. 1, the only legs 13 required are those at the lakeward end of each section 5. When other configurations facilitated by the connections shown in FIGS. 6, 8, and 9 are used, additional support legs 13 may be needed. FIG. 10 shows the use of a hat section leg clamp bracket 29 and U bolts 19 which wrap around a longitudinal member and affix a leg 13 to a dock section longitudinal 10 at any point. These brackets 29 are used to support corners where the dock structure changes directions and may also be used as starters at the shoreward end of the dock structure. The depth of the hat section is somewhat less than the corresponding width of the cross-section of a captured leg 13 to allow compression between the clamp bracket 29 and leg 13.

Figure 11:
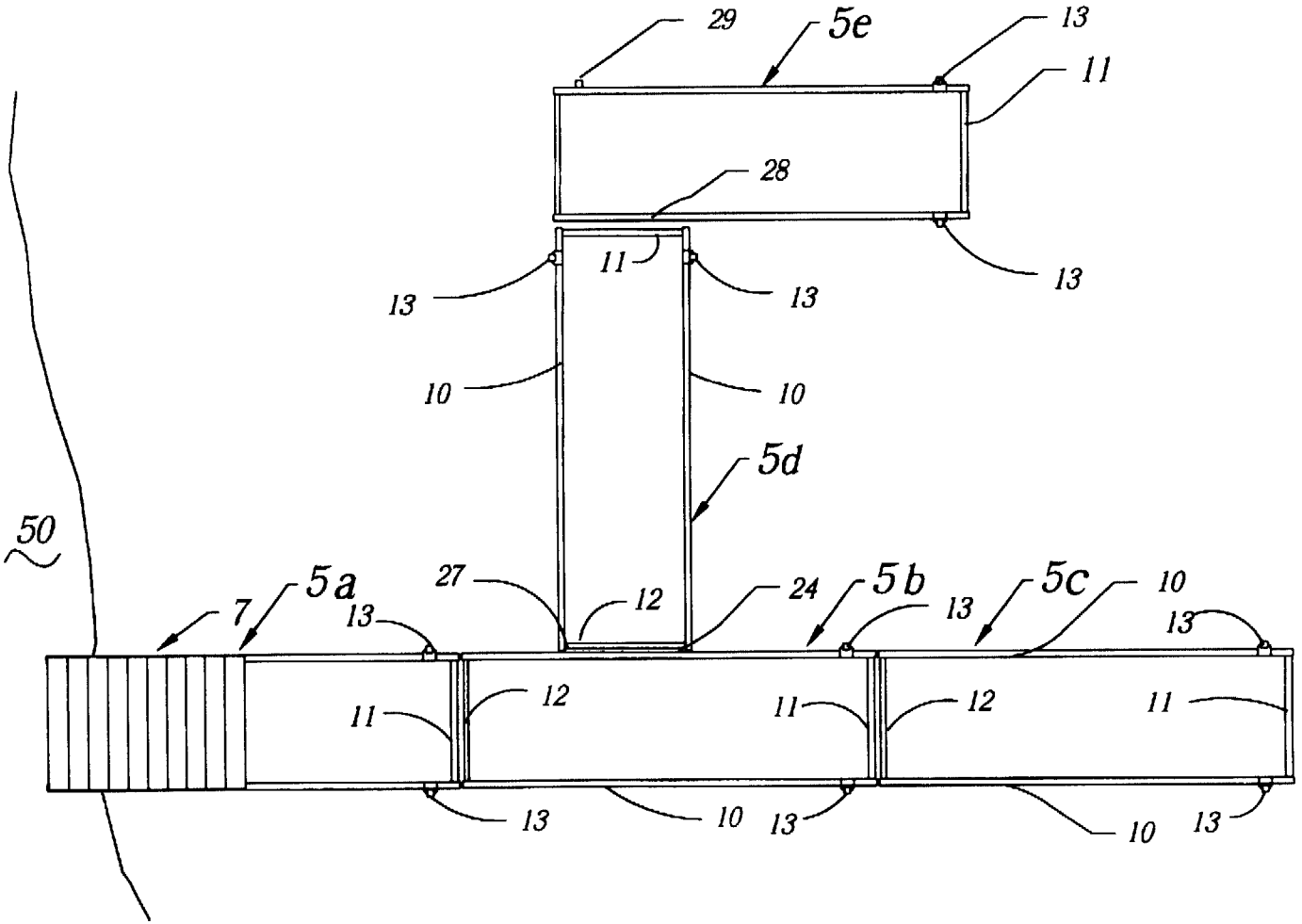

FIG. 11 is a top plan view showing one of many possible arrangements of multiple dock sections 5 to form a complete dock structure. Shown are the use of either wing support straps 24 or wing plates 27 to start a section of dock 5*d* perpendicular to a previously installed section 5*b*.

Also shown in FIG. 11 are the locations on a section 5*c* where a Z clip 28 and a hat section leg clamp bracket 29 would be used to turn an outside corner.

b. Installation

The invention improves upon existing docks, and constitutes an advance over the prior art in the following manner. The invention comprises modular aluminum dock sections which can be easily installed and assembled into a wide variety of dock shapes and configurations.

Each dock section is constructed to be lightweight and easily manipulated for installation; each comprises two tubular aluminum longitudinal members 10 with transverse tubular aluminum cross members 11 and 12, at each end and at least two tubular aluminum legs 13. The shoreward (or inner or near) transverse member 12 is of circular section, and relatively small diameter, so that it may be used for a handle over its entire length.

The use of tubular members without flanges is significant, since it is intended to create a very light structure, prior to installation of decking, which also has great resistance to torsional deflection around a horizontal, longitudinal axis when transverse member 11 is used to manipulate a section. These features are significant elements of the invention and the installation method which it makes possible.

No individual element of the dock system, including a basic structural section itself with two legs, will weigh more than about fifty (50) pounds, and the weight of the basic section without legs or decking should not exceed four (4) pounds per lineal foot.

Installation of the first dock section is from shore. To install additional sections, decking 7 is placed and the installer stands on it to place the next section.

Installation of the first and succeeding sections occurs in the following manner. Legs are attached to a rectangular section consisting of members 10, 10, 11 and 12, and set to approximately the correct height. Generally, it is desired that decking be about a foot above the water surface.

Legs 13 are attached to the dock section 5 using the clamping mechanism 6 described above. This comprises open leg guides 17, 18 attached to the top and bottom of the longitudinal members 10 and a clamping element 19, typically a U bolt. The leg guides 17 and 18 have a U shaped recess, into which each leg 13 is inserted from outboard. The outer edges of the recess, that is, the legs of the U, prevent rotation of the dock legs 13 about a horizontal axis perpendicular to the longitudinal member 10. Forcing each leg 13 against the inboard edge of the recess (the bottom of the U) forces them into vertical alignment. The friction resulting from clamping prevents relative movement of dock section 5 and leg 13. Also, the leg 13 can be removed and replaced without disturbing the position of a dock section.

The guides 17,18 are also designed to displace the legs 13 slightly outboard of the dock section 5 itself when installed. This offset outboard from longitudinal members is a useful element because it permits numerous dock sections to be compactly nested for storage with the legs 13 still attached to the sections 5.

Alternatively, because the clamping element is removable, legs 13 can be removed for storage. This permits storing the clamp or U bolt 19 away from bad weather and resulting corrosion and permits easy replacement.

The dock section, with legs attached, is carried to the shore or out to the end of those sections previously installed, and placed with the bearing pads on the bottom. Depth gauges 23 are attached to the lakeward transverse. Once the dock section is maneuvered into roughly the appropriate position, visual reference to these gauges 23 reveals whether the leg height is correctly set and whether the dock section 5 will be level when installation is complete.

The installer, facing out into the lake, grasps both sides of the shoreward transverse/handle 12. The section 5 is moved into position by applying a torque (clockwise or counter-clockwise) about the horizontal, longitudinal axis. This lifts one leg 13 off the bottom.

The installer then rotates the section about the nearly vertical axis coinciding with the supporting leg 13. This forces the unburdened leg out into the lake. A step of approximately 1 to 1.5 feet is easily achieved. Relaxing the applied torque lets the elevated leg return to the bottom. The process is then repeated with the other leg 13, alternating side to side until the end of the section 5 is "walked" into the desired location. The weight and strength of the members 10, 10 11 and 12 of each section and their connections (preferably welds) at the corners where they meet, together with the weight of the attached legs are selected to meet two objectives. First, a person of ordinary strength is able to perform the rotation and lifting just described to "walk" the section lakeward. Second, the rotation and lifting just described should cause no substantial deflection of the common plane defined by members 10, 10, 11 and 12 forming the section manipulated.

The height of the lakeward end of the section is then observed on the gauges 23. If leveling or height adjustment is needed, the section is dragged back to where the legs 13 can be reached. This is facilitated by the flanges 30 at the edges of the bearing pads 14. Any required adjustment of leg height is completed by loosening U bolt clamps 19; gauges 23 are removed, and the section is walked back into position.

A new section 5, installed end-to-end with a prior section 5 is hooked to the prior section by inserting the hook plates 20 which project from the open end of each tubular longitudinal member 10 into the end of the corresponding tubular longitudinal member 10 of the prior section. The slot, tab and pin arrangement 22,40 and 26 discussed above precludes the sections from unintended uncoupling.

Decking pallets 7 which may be of wood or plastic, rest atop the upper surfaces of the section longitudinals 10 and are held in place laterally by their longitudinal cleats 9 (FIG. 2). Any accessories are bolted on, and the dock section is complete.

Further dock height adjustment can be effected once the dock is installed by supporting one or both sides of the dock with a "dock jack" or other implement. The section 5 is simply lifted and supported, the U bolts 19 loosened, and the leg 13 slid to the new required height.

Vertical legs 13 rest at the lake bottom on aluminum bearing pads 14. Overall footprint width of the section is an important factor in lateral stability. Height adjustment is facilitated by keeping the dock legs vertical. These conflicting objectives are accomodated by locating the bearing pads 14 so they are not symmetrical with respect to the associated dock leg 13. Rather, they are shifted outboard, away from the dock centerline in order to increase stability. That is, the center of area of the bearing pad 14 is outboard of the center of the leg 13.

Although this description encompasses the preferred embodiment of the invention, it should be understood that numerous other modifications and embodiments can be devised by those skilled in the art which will fall within the spirit and scope of the principles of this invention.

I claim:

1. A modular section for use in a dock comprising:

first and second longitudinal members in parallel, spaced relation, each longitudinal member having a lakeward end and a shoreward end;

a lakeward transverse member connected to and extending between the lakeward ends of the first and second longitudinal members;

a shoreward transverse member connected to and extending between the shoreward ends of the first and second longitudinal members;

a pair of support legs, one connected to each of the first and second longitudinal members adjacent the lakeward end of such longitudinal member; and the first and second longitudinal members and the lakeward and shoreward transverse members being substantially in a common plane and being formed of lightweight tubular material with rigid connections such that a torque applied to the shoreward transverse member that is in a direction to cause rotation about a substantially horizontal axis and is sufficient to remove all load from one of the support legs causes no substantial deflection of the first and second longitudinal members and the lakeward and shoreward transverse members out of their common plane, and;

further comprising means for connecting the first and second longitudinal members of that section to third and fourth longitudinal members of another section of like structure so that the shoreward end of the third longitudinal member abuts the lakeward end of the first longitudinal member and the shoreward end of the the fourth longitudinal member abuts the lakeward end of the second longitudinal member with the shoreward transverse member connecting the third and fourth longitudinal members lying parallel to and adjacent to the lakeward transverse member connecting the first and second longitudinal members, said means for connecting comprising:

a slot in the bottom of each of the first and second longitudinal members adjacent to their associated lakeward transverse member;

a hook plate attached to the inside of each of the third and fourth longitudinal members, each said hook plate having a tab that extends out of the longitudinal member to which it is attached for insertion through and out of the slot in a corresponding one of the first and second longitudinal members; and a pin for passing through a hole in a portion of the tab of each hook plate that extends out of the corresponding one of the first and second longitudinal members.

2. A modular section for use in a dock comprising:

first and second longitudinal members in parallel, spaced relation, each longitudinal member having a lakeward end and a shoreward end;

a lakeward transverse member connected to and extending between the lakeward ends of the first and second longitudinal members;

a shoreward transverse member connected to and extending between the shoreward ends of the first and second longitudinal members;

a pair of support legs, one connected to each of the first and second longitudinal members adjacent the lakeward end of such longitudinal member; and the first and second longitudinal members and the lakeward and shoreward transverse members being substantially in a common plane and being formed of lightweight tubular material with rigid connections such that a torque applied to the shoreward transverse member that is in a direction to cause rotation about a substantially horizontal axis and is sufficient to remove all load from one of the support legs causes no substantial deflection of the first and second longitudinal members and the lakeward and shoreward transverse members out of their common plane, and;

further comprising means for connecting a leg at any point along the first or second longitudinal members, said means for connecting a leg comprising;

first and second U-shaped bolts, each passing around a longitudinal member to which a leg is to be attached;

a hat section leg clamp bracket, with first and second flanges and holes for receiving the ends of the first and second U-shaped bolts; and the hat section leg clamp being sized to receive a leg for clamping against the longitudinal member to which the leg is to be attached under compression from the first and second U-shaped bolts.

3. A modular section for use in a dock comprising:

first and second longitudinal members in parallel, spaced relation, each longitudinal member having a lakeward end and a shoreward end;

a lakeward transverse member connected to and extending between the lakeward ends of the first and second longitudinal members;

a shoreward transverse member connected to and extending between the shoreward ends of the first and second longitudinal members;

a pair of support legs, one connected to each of the first and second longitudinal members adjacent the lakeward end of such longitudinal member; and the first and second longitudinal members and the lakeward and shoreward transverse members being substantially in a common plane and being formed of lightweight tubular material with rigid connections such that a torque applied to the shoreward transverse member that is in a direction to cause rotation about a substantially horizontal axis and is sufficient to remove all load from one of the support legs causes no substantial deflection of the first and second longitudinal members and the lakeward and shoreward transverse members out of their common plane, and;

further comprising means for connecting a further modular section of like structure having third and fourth longitudinal members to one of the first and second longitudinal members so that the third and fourth longitudinal members lie perpendicular to the one of the first and second longitudinal members, said means for connecting comprising:

at least one wing support strap in the form of an inverted U-shaped hanger with legs that are adapted to hang over one of the first and second longitudinal members to which the further section is attached, said hanger having an opening adjacent the end of each of its legs;

a wing support strut adapted to be attached to the inboard side of at least one of the third and fourth longitudinal members, said wing support strut having a tab that extends past the end of the longitudinal member to which it is attached for insertion through the openings in the at least one wing support strap;

a pin adapted to pass through a hole in a portion of the tab of the at least one wing support strut that extends through the openings in the at least one wing support strap.

4. A method of installing in a body of water a dock made up of one or more modular sections, each section comprising:

first and second longitudinal members in parallel, spaced relation, each of the first and second longitudinal members having a lakeward end and a shoreward end;

a lakeward transverse member connected to and extending between the lakeward ends of the first and second longitudinal members;

a shoreward transverse member connected to and extending between the shoreward ends of the first and second longitudinal members;

a pair of support legs, one connected to each of the first and second longitudinal members adjacent the lakeward end of such longitudinal member; and the first and second longitudinal members and the lakeward and shoreward transverse members being substantially in a common plane and being formed of lightweight tubular material with rigid connections, the method comprising:

(a) placing the section so that its pair of support legs are in the body of water;

(b) grasping the shoreward transverse member of the section;

(c) applying a torque to the shoreward transverse member that is in a direction to cause rotation about a substantially horizontal axis and is sufficient to remove all load from one of the support legs while causing no substantial deflection of the first and second longitudinal members and the lakeward and shoreward transverse members out of their common plane;

(d) rotating the section about a substantially vertical axis coincident with the supporting leg from which load has not been removed, to advance the leg from which load is removed into the body of water; and (e) relaxing the applied torque so as to restore load to both legs and repeating steps (c) and (d) with the other leg.

5. The method as recited in claim 4 further comprising placing decking in an installed section and using it as a platform from which another section is installed.

6. The method as recited in claim 4 further comprising removably attaching at least one height gauge to the lakeward transverse member of a section being installed for displaying the distance between the surface of the body of water in which the section is installed and the common plane of the first and second longitudinal members and the lakeward and shoreward transverse members of such section.

7. The method as recited in claim 4, further comprising connecting a third longitudinal member of another section of like structure to the lakeward transverse member connecting the first and second longitudinal members so that the third longitudinal member lies parallel to and adjacent to the lakeward transverse member connecting the first and second longitudinal members by:

placing one side of a Z bracket having a Z-shaped section to hang on the lakeward transverse member connecting the first and second longitudinal members; and placing the other side of the Z bracket to underlie and support the third longitudinal member.

* * * * *